US006056706A

United States Patent [19]

Hung

[11] Patent Number: 6,056,706

[45] Date of Patent: May 2, 2000

[54] FOOT SUSPENDED EXERCISE ROCKING MACHINE

[76] Inventor: Shou-Ju Hung, 58, Ma Yuan West St., Taichung, Taiwan

[21] Appl. No.: 09/303,746

[22] Filed: May 3, 1999

[51] Int. Cl.[7] ..... A61H 1/00

[52] U.S. Cl. ..... 601/89; 601/35; 601/87; 601/101; 601/98

[58] Field of Search ..... 601/23, 27, 29, 601/31, 32, 35, 49, 50, 51, 53, 54, 58, 85, 86, 87, 90, 93, 98, 101, 104

[56] References Cited

U.S. PATENT DOCUMENTS 2,648,332 8/1953 Johnson .
5,107,822 4/1992 Ohashi .
5,328,443 7/1994 Lee .
5,411,469 5/1995 Wang .
5,417,644 5/1995 Lee .

*Primary Examiner*—Danton D. DeMille

[57] ABSTRACT

A rocking machine has an outer casing, an upper seat, a motor, a hollow connector, a drive member, a right rocking member, and a left rocking member. The motor which is disposed in the outer casing has a shaft inserted in the hollow connector. The hollow connector has an upper rod. The drive member has an upper block, a lower oblong groove, and two lower oblong recesses. The right rocking member has an upper through aperture and a lower through aperture. The left rocking member has an upper through hole and a lower through hole. The upper rod is inserted in the lower oblong groove. The upper seat is disposed on the drive member. The right rocking member receives a right lower portion of the drive member. The left rocking member receives a left lower portion of the drive member. Four angle plates are fastened in the outer casing to position the right and the left rocking members pivotally.

1 Claim, 7 Drawing Sheets

FOOT SUSPENDED EXERCISE ROCKING MACHINE

BACKGROUND OF THE INVENTION

The present invention relates to a rocking machine. More particularly, the present invention relates to a rocking machine which is used as a foot exercise machine.

A conventional rocking machine which is used as a foot exercise machine has a complex structure. Since the structure of the conventional rocking machine is very complex, it is not easy to replace a broken part which is disposed in the conventional rocking machine.

SUMMARY OF THE INVENTION

An object of the present invention is to provide a rocking machine which is easily assembled.

Another object of the present invention is to provide a rocking machine which is easily detached.

Another object of the present invention is to provide a rocking machine which can vibrate an upper seat upward, rightward, downward, and leftward in cycle.

Accordingly, a rocking machine comprises an outer casing, an upper seat, a motor, a hollow connector, a drive member, a right rocking member, and a left rocking member. The outer casing has an upper opening. The motor is disposed in the outer casing. The motor has a shaft inserted in the hollow connector. The hollow connector has an upper rod. The drive member has an upper block, a lower oblong groove, and a first and a second lower oblong recesses. The right rocking member has an upper through aperture and a lower through aperture. The left rocking member has an upper through hole and a lower through hole. The upper rod is inserted in the lower oblong groove of the drive member. The drive member passes through the upper opening of the outer casing. The upper seat is disposed on a top portion of the drive member. The right rocking member receives a right lower portion of the drive member. The right rocking member has a lower through aperture and an upper through aperture matching the first lower oblong recess. The left rocking member receives a left lower portion of the drive member. The left rocking member has a lower through hole and an upper through hole matching the second lower oblong recess. A first, a second, a third, and a fourth angle plates are fastened in the outer casing. The first angle plate has a first positioning hole. The second angle plate has a second positioning hole. The third angle plate has a third positioning hole. The fourth angle plate has a fourth positioning hole. A first pin fastens the left rocking member and the left lower portion of the drive member together. A second pin fastens the right rocking member and the right lower portion of the drive member together. A third pin fastens the right rocking member and the first and the second angle plates together via the lower through aperture and the first and the second positioning holes. A fourth pin fastens the left rocking member and the third and the fourth angle plates together via the lower through hole and the third and the fourth positioning holes.

DETAILED DESCRIPTION OF THE INVENTION

Figure 1:
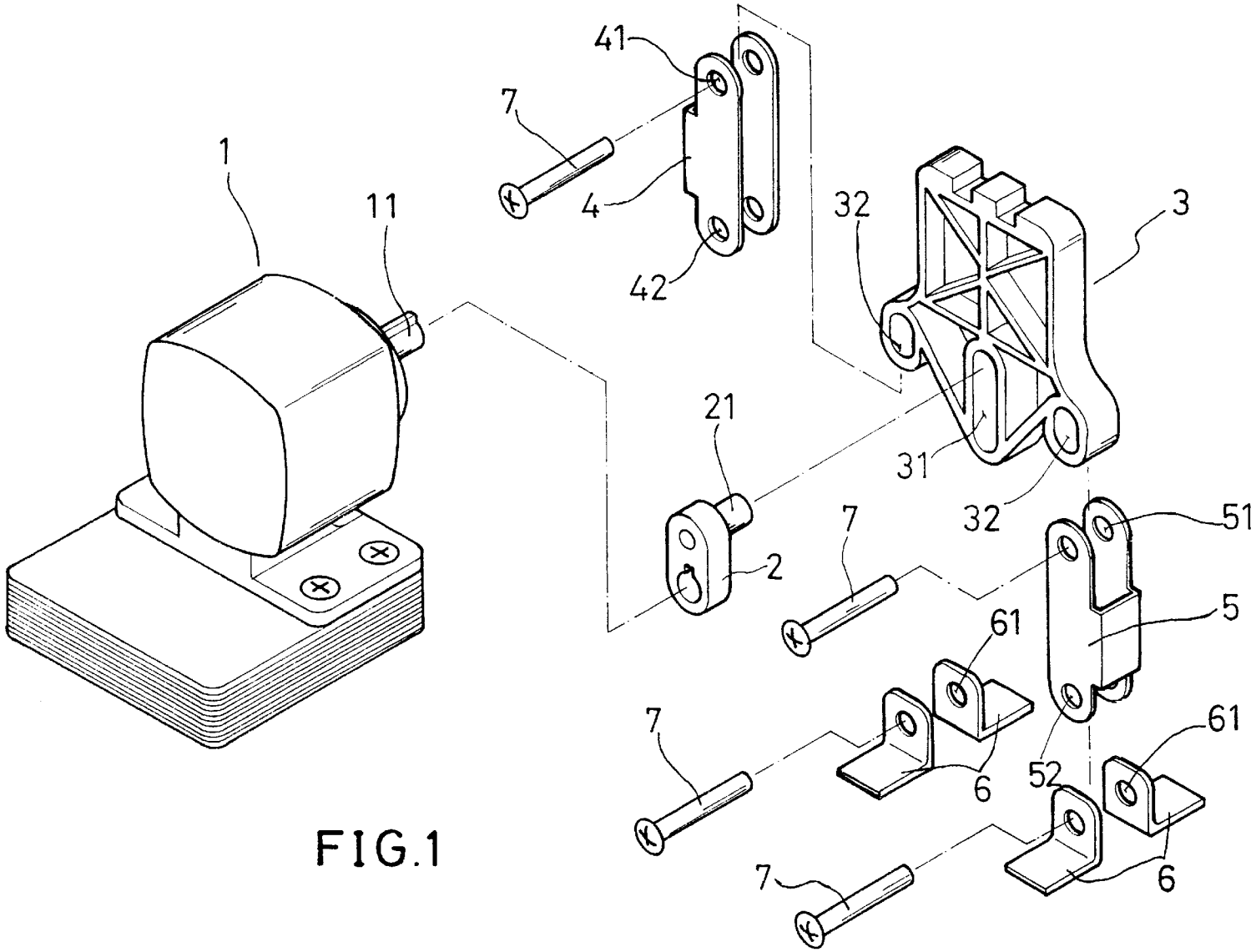
FIG. 1 is a perspective exploded view of a rocking machine of a preferred embodiment without an outer casing and an upper seat.
Figure 2:
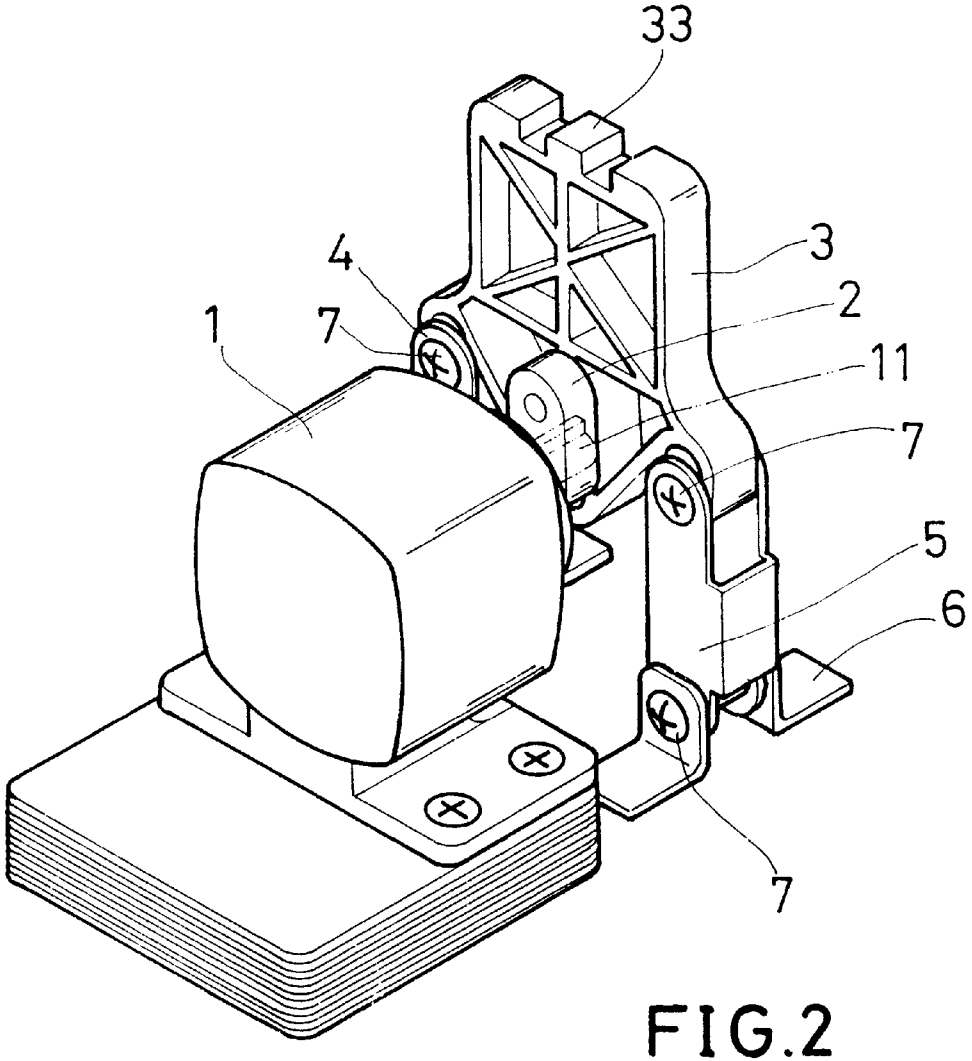
FIG. 2 is a perspective assembly view of FIG. 1.
Figure 3:
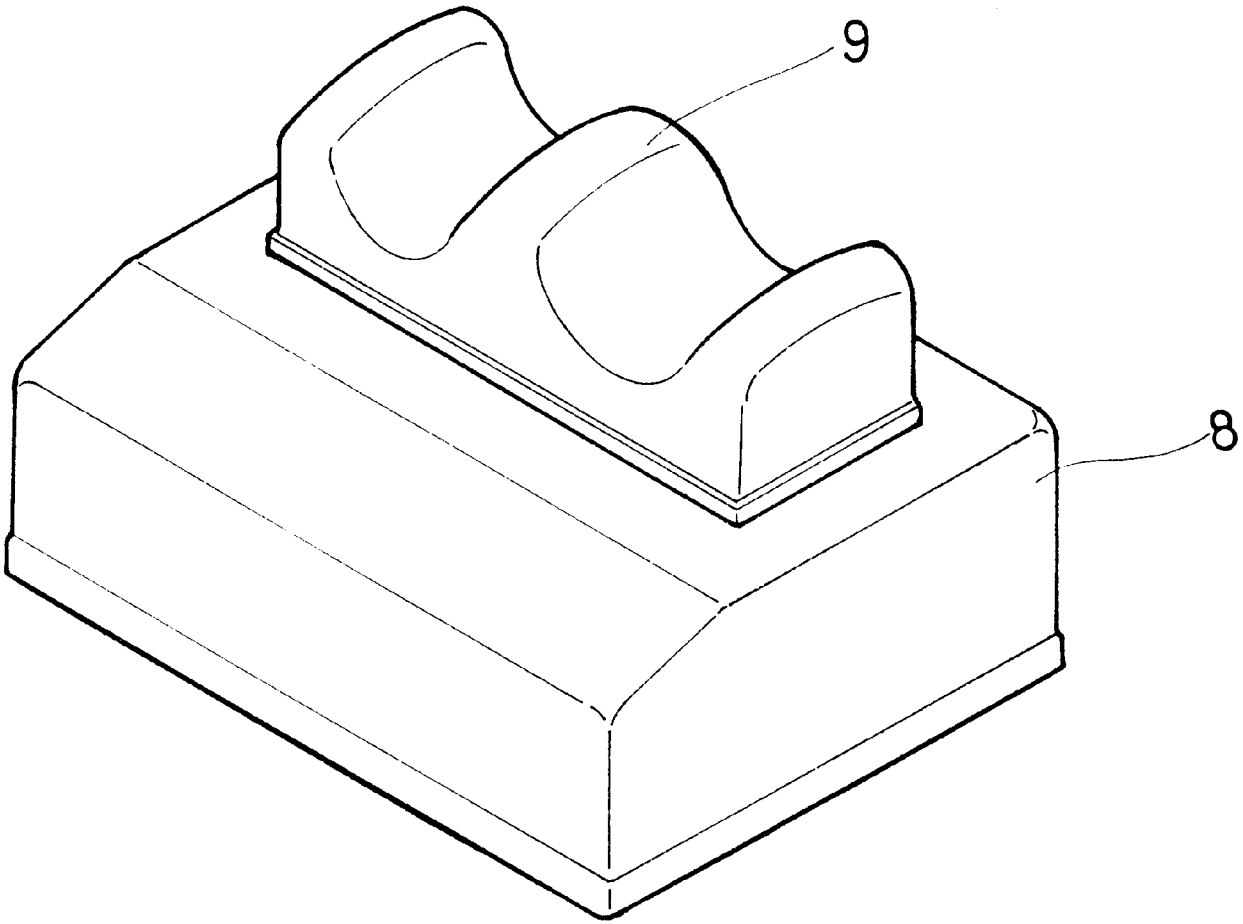
FIG. 3 is a perspective assembly view of a rocking machine of a preferred embodiment in accordance with the present invention.

Referring to FIGS. 1 to 4, a rocking machine comprises an outer casing 8, an upper seat 9, a motor 1, a hollow connector 2, a drive member 3, a right rocking member 5, and a left rocking member 4.

The outer casing 8 has an upper opening 81.

The motor 1 is disposed in the outer casing 8.

The motor 1 has a shaft 11 inserted in the hollow connector 2.

The hollow connector 2 has an upper rod 21.

The drive member 3 has an upper block 33, a lower oblong groove 31, and a first and a second lower oblong recesses 32.

The right rocking member 5 has an upper through aperture 51 and a lower through aperture 52.

The left rocking member 4 has an upper through hole 41 and a lower through hole 42.

The upper rod 21 is inserted in the lower oblong groove 31 of the drive member 3.

The drive member 3 passes through the upper opening 81 of the outer casing 8.

The upper seat 9 is disposed on a top portion of the drive member 3.

The right rocking member 5 receives a right lower portion of the drive member 3. The right rocking member 5 has a lower through aperture 52 and an upper through aperture 51 matching the first lower oblong recess 32.

The left rocking member 4 receives a left lower portion of the drive member 3. The left rocking member 4 has a lower through hole 42 and an upper through hole 41 matching the second lower oblong recess 32.

A first, a second, a third, and a fourth angle plates 6 are fastened in the outer casing 8.

The first angle plate 6 has a first positioning hole 61. The second angle plate 6 has a second positioning hole 61. The third angle plate 6 has a third positioning hole 61. The fourth angle plate 6 has a fourth positioning hole 61.

A first pin 7 fastens the left rocking member 4 and the left lower portion of the drive member 3 together.

A second pin 7 fastens the right rocking member 5 and the right lower portion of the drive member 3 together.

A third pin 7 fastens the right rocking member 5 and the first and the second angle plates 6 together via the lower through aperture 52 and the first and the second positioning holes 61.

A fourth pin 7 fastens the left rocking member 4 and the third and the fourth angle plates 6 together via the lower through hole 42 and the third and the fourth positioning holes 61.

Figure 4:
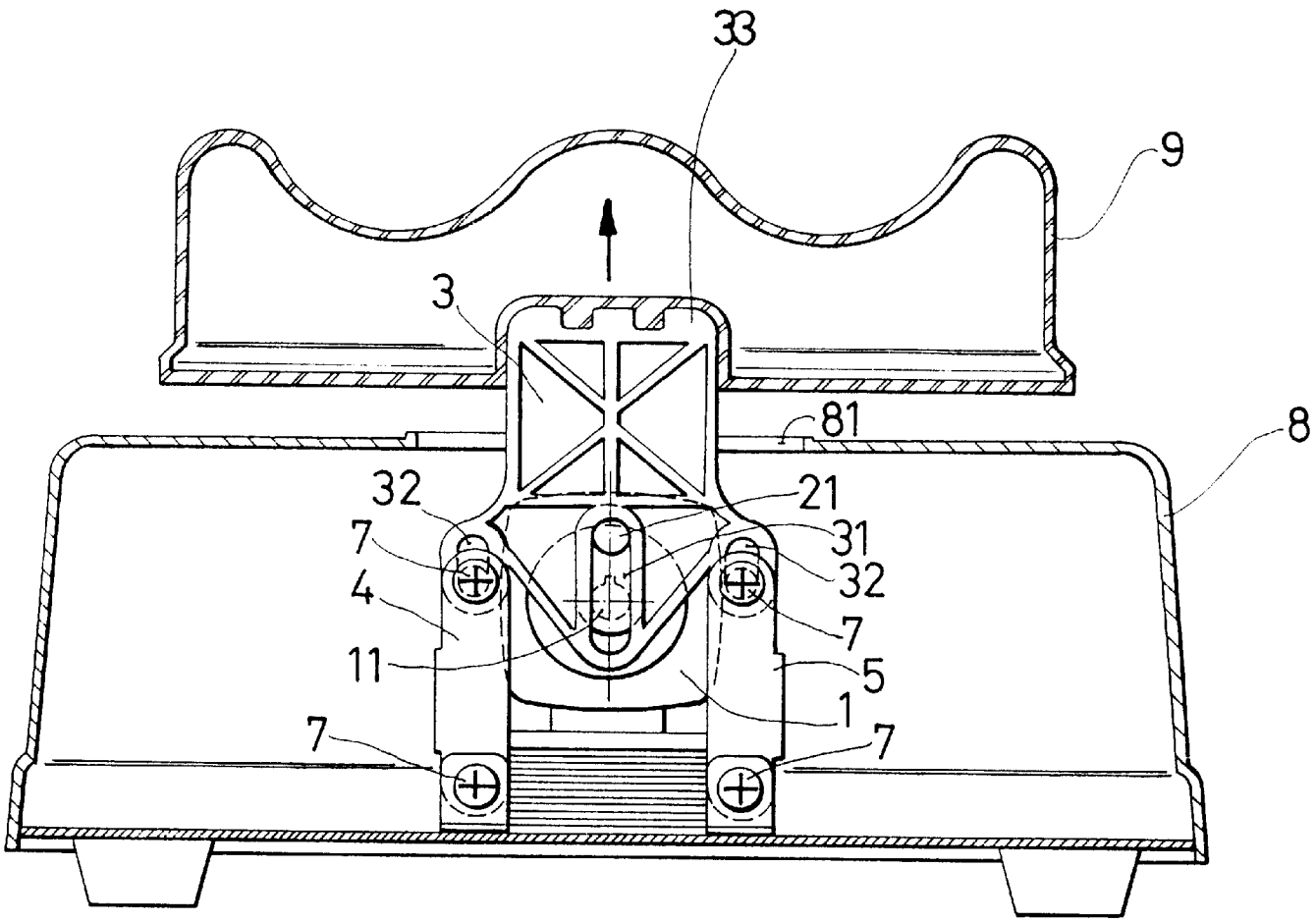
FIG. 4 is a schematic view illustrating an operation of a rocking machine while an upper seat is moved upward.

Referring to FIG. 4, the motor 1 drives the drive member 3 and the upper seat 9 to move upward.

Figure 5:
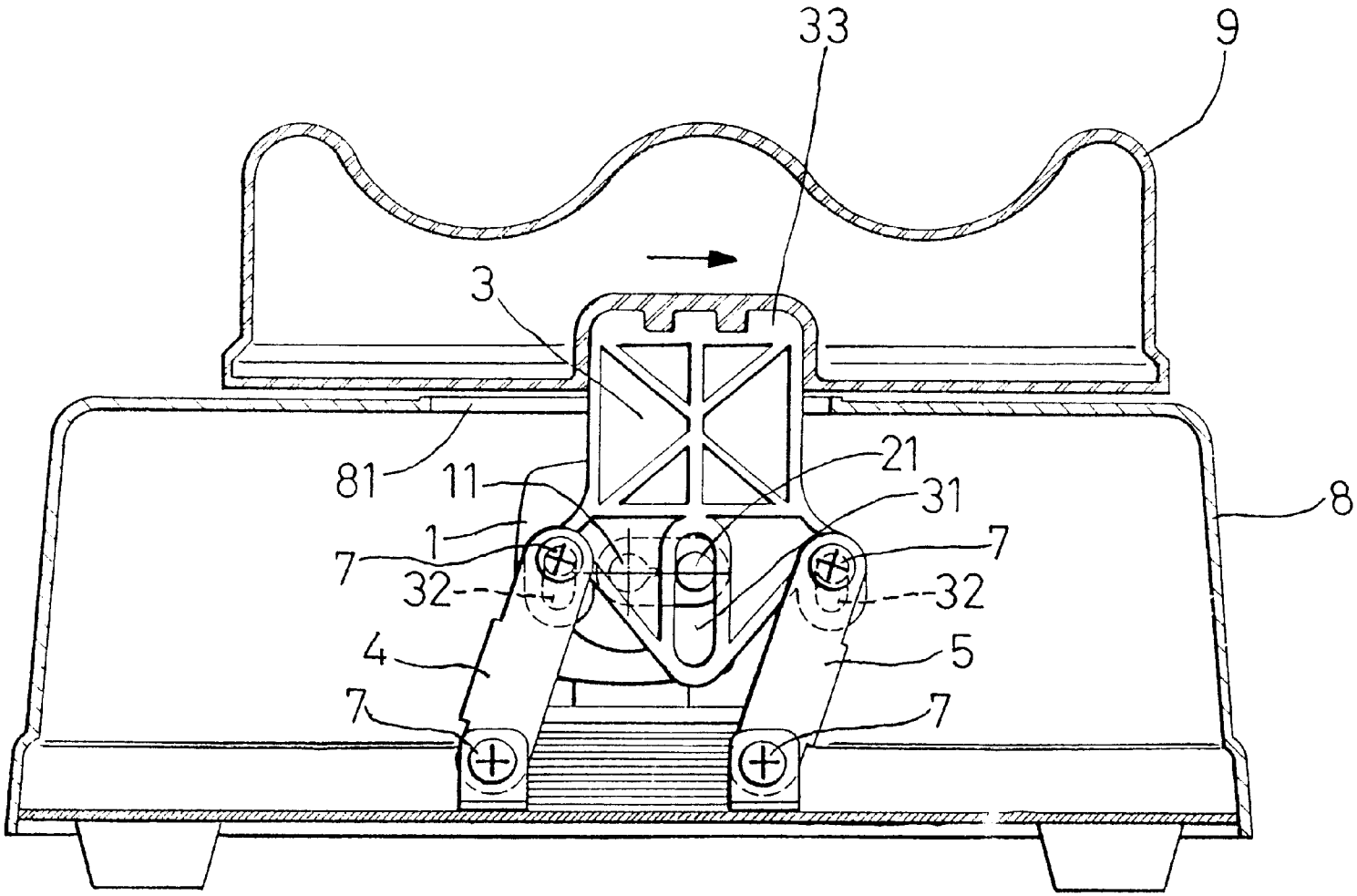
FIG. 5 is a schematic view illustrating an operation of a rocking machine while an upper seat is moved rightward.

Referring to FIG. 5, the motor 1 drives the drive member 3 and the upper seat 9 to move rightward.

Figure 6:
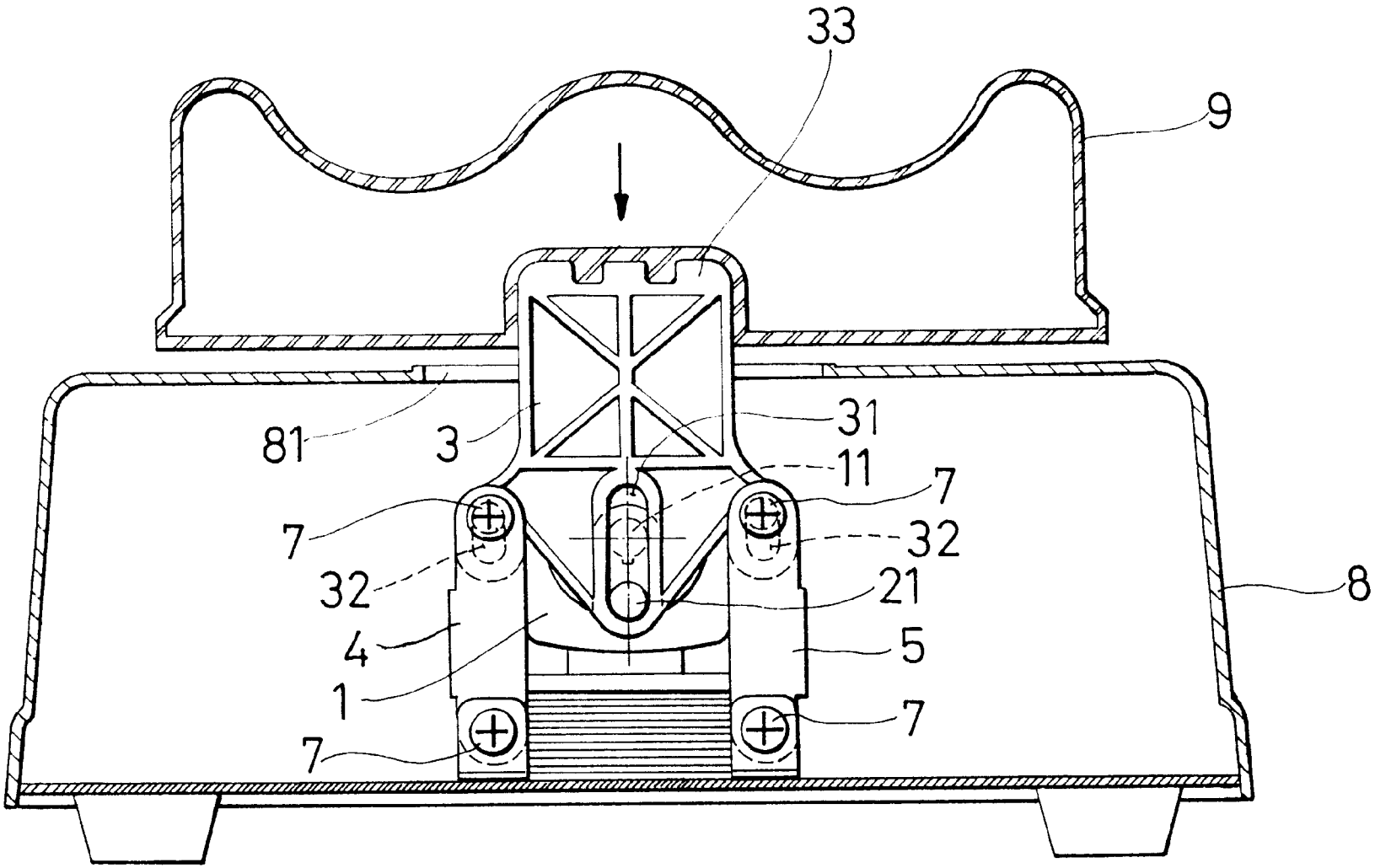
FIG. 6 is a schematic view illustrating an operation of a rocking machine while an upper seat is moved downward.

Referring to FIG. 6, the motor 1 drives the drive member 3 and the upper seat 9 to move downward.

Figure 7:
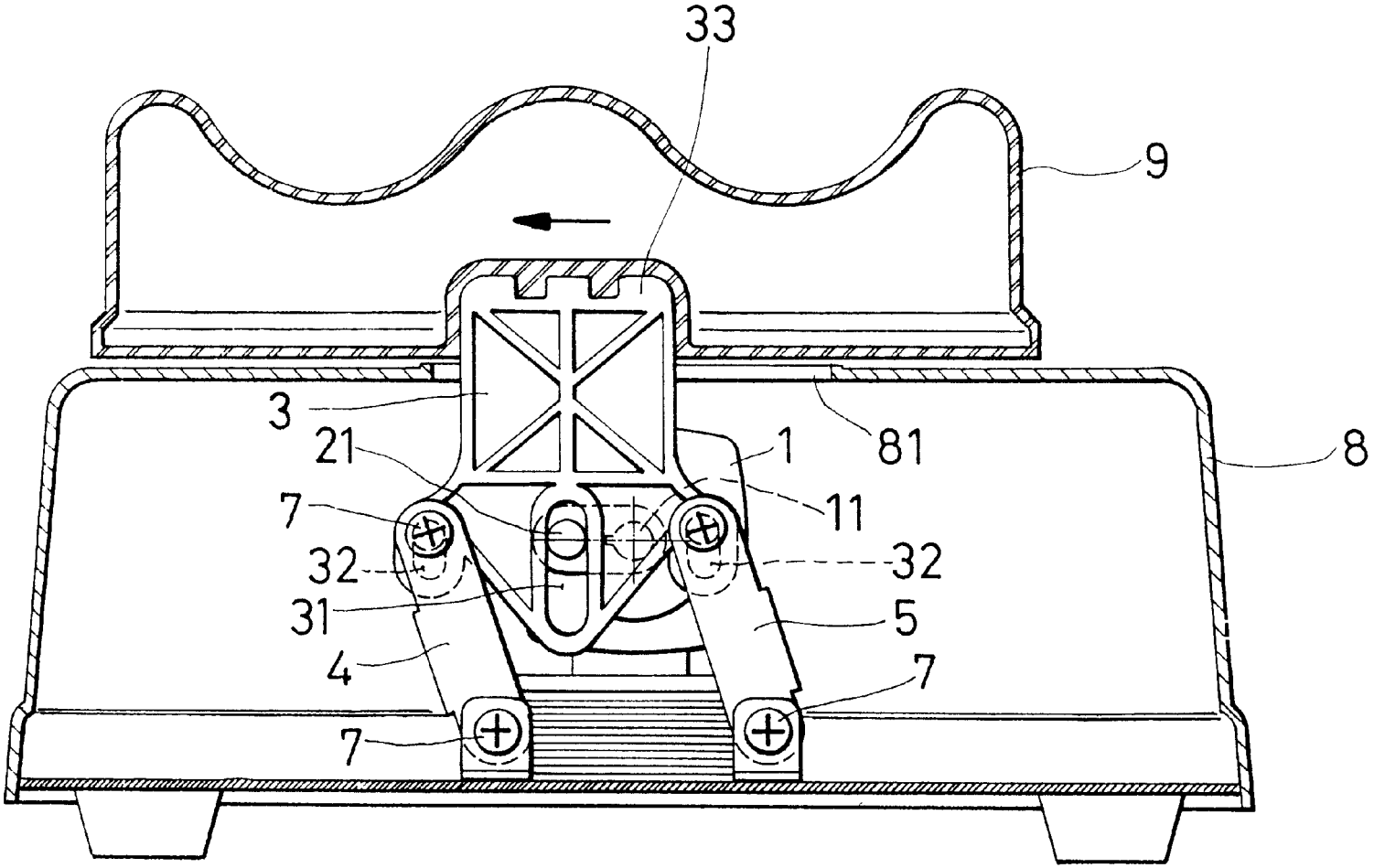
FIG. 7 is a schematic view illustrating an operation of a rocking machine while an upper seat is moved leftward.

Referring to FIG. 7, the motor 1 drives the drive member 3 and the upper seat 9 to move leftward.

The present invention is not limited to the above embodiment but various modification thereof may be made. Furthermore, various changes in form and detail may be made without departing from the scope of the present invention.

I claim:

1. A rocking machine comprises:

an outer casing, an upper seat, a motor, a hollow connector, a drive member, a right rocking member, and a left rocking member, the outer casing having an upper opening, the motor disposed in the outer casing, the motor having a shaft inserted in the hollow connector, the hollow connector having an upper rod, the drive member having an upper block, a lower oblong groove, and a first and a second lower oblong recesses, the right rocking member having an upper through aperture and a lower through aperture, the left rocking member having an upper through hole and a lower through hole, the upper rod inserted in the lower oblong groove of the drive member, the drive member passing through the upper opening of the outer casing, the upper seat disposed on a top portion of the drive member, the right rocking member receiving a right lower portion of the drive member, the right rocking member having a lower through aperture and an upper through aperture matching the first lower oblong recess, the left rocking member receiving a left lower portion of the drive member, the left rocking member having a lower through hole and an upper through hole matching the second lower oblong recess, a first, a second, a third, and a fourth angle plates fastened in the outer casing, the first angle plate having a first positioning hole, the second angle plate having a second positioning hole, the third angle plate having a third positioning hole, the fourth angle plate having a fourth positioning hole, a first pin fastening the left rocking member and the left lower portion of the drive member together, a second pin fastening the right rocking member and the right lower portion of the drive member together, a third pin fastening the right rocking member and the first and the second angle plates together via the lower through aperture and the first and the second positioning holes, and a fourth pin fastening the left rocking member and the third and the fourth angle plates together via the lower through hole and the third and the fourth positioning holes.

* * * * *